US007744266B2

(12) United States Patent
Higley et al.

(10) Patent No.: US 7,744,266 B2
(45) **Date of Patent: *Jun. 29, 2010**

(54) LED SOCKET AND REPLACEABLE LED ASSEMBLIES

(75) Inventors: Robert Edward Higley, Cary, NC (US); Faramarz Hafezi, Wake Forest, NC (US)

(73) Assignee: Cree, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/432,820

(22) Filed: Apr. 30, 2009

(65) Prior Publication Data

US 2009/0207609 A1 Aug. 20, 2009

Related U.S. Application Data

(63) Continuation of application No. 11/614,261, filed on Dec. 21, 2006, now Pat. No. 7,549,786.

(60) Provisional application No. 60/868,162, filed on Dec. 1, 2006.

(51) Int. Cl.
*F21V 23/04* (2006.01)

(52) U.S. Cl. ..... 362/646; 362/800; 362/652; 362/640

(58) Field of Classification Search ..... 362/646, 362/800, 652, 640
See application file for complete search history.

(56) References Cited

U.S. PATENT DOCUMENTS 6,386,733 B1 * 5/2002 Ohkohdo et al. ..... 362/249.06
7,322,718 B2 * 1/2008 Setomoto et al. ..... 362/276
7,549,786 B2 * 6/2009 Higley et al. ..... 362/646

* cited by examiner

*Primary Examiner*—Anabel M Ton
(74) *Attorney, Agent, or Firm*—Priest & Goldstein, PLLC

(57) ABSTRACT

Socket arrangements for releasably mounting LEDs and light fixtures or assemblies employing such sockets are described. The socket arrangements facilitate the replacement of LEDs to replace an original LED with a brighter replacement, to change the color of the LED, to replace a single LED with a multiple chip LED, to replace a damaged or burned out LED with a new one, or the like. In further assemblies with plural LEDs, the use of ready release sockets facilitates selective replacement of an LED or LEDs and greatly enhances the flexibility of such units.

20 Claims, 16 Drawing Sheets

LED SOCKET AND REPLACEABLE LED ASSEMBLIES

FIELD OF THE INVENTION

The present invention relates generally to improved methods and apparatus for mounting LEDs, and more particularly to improved LED sockets allowing LEDs to be releasably mounted and readily replaced, and LED assemblies utilizing said sockets.

BACKGROUND OF THE INVENTION

In many typical mounting arrangements, LEDs are mounted in a mounting assembly or mount which is then soldered to a printed circuit board using reflow surface mount techniques. In such arrangements, to remove and replace a defective or burned out LED, or to change out one LED for another, it is necessary to heat the solder holding the original LED mount in place to its melting point and then to remove the original LED mount, clean the board, and then to resolder a replacement LED mount in its place. Alternatively, a whole new replacement board may be utilized to avoid the step of replacing the LED completely. Both of these approaches have their drawbacks with respect to ease of replacement, cost or the like.

In an alternative approach, an LED has been mounted in a threaded sleeve which fits in a standard incandescent light bulb socket. While such an arrangement has the benefit of being easy to replace in a manner intuitively obvious to the average consumer, it suffers from having a relatively bulky form factor that may prevent optimal design of a lighting fixture to take advantage of the small size of the LED light source. It also has a relatively high cost.

Additionally, LED-based fixtures with multiple LEDs are being developed and are becoming more prevalent. These fixtures do not typically have a sufficiently easy and cost effective mechanism for replacing individual LEDs.

SUMMARY OF THE INVENTION

In such applications, as well as others, the present inventors have recognized that it would be highly desirable to provide an improved mounting arrangement to allow individual LEDs to be easily replaced within a fixture. For example, it may be desirable to replace LEDs due to failure or the desire to change the brightness, the color, or the like of the fixture.

As addressed in greater detail below, the present inventors have also recognized that in a wide variety of applications and contexts, an improved mounting arrangement which allows the ready replacement of LEDs without the use of heat and solder, or an artificial retrofit packaging arrangement such as a modified incandescent bulb threaded connector would be highly desirable.

According to one aspect, the present invention addresses a socket for releasably mounting an LED lamp comprising an LED chip in a package, the socket comprising socket power contacts for contacting lamp power contacts on the LED lamp and supplying power to the LED chip; and a mechanism for maintaining said socket power contacts in electrical contact with said lamp power contacts during operation and for allowing the LED lamp to be readily removed and replaced when it is desired to replace the LED lamp.

According to another aspect, the present invention addresses an LED lighting module comprising a printed circuit board; and a plurality of LED lamp sockets physically mounted and electrically connected on the printed circuit board, wherein the LED lamp sockets provide a releasable mechanism for the ready insertion and removal of LED lamps in the LED lamp sockets without the use of heat, solder, or physical force beyond normal hand pressure.

According to another aspect, the present invention addresses a portable personal LED light with a replaceable LED lamp comprising: a power switch for turning power on and off; a readily releasable LED lamp socket; an LED lamp; and a housing.

A more complete understanding of the present invention, as well as further features and advantages, will be apparent from the following Detailed Description and the accompanying drawings.

BRIEF DESCRIPTION OF THE DRAWINGS

FIGS. 14A and 14B show side and top views, respectively, of a second typical prior art LED lamp suitable for mounting on a printed circuit board;

DETAILED DESCRIPTION

LEDs may be employed in a wide variety of lighting applications in which it is desirable to replace one LED with another. By way of example, in personal and portable lights which are battery-operated, such as an LED flashlight, for example, it may be desirable to replace an original LED with a brighter replacement LED, an LED having a different color, or if the original LED has become damaged or burned out with a new one. Similarly, in headlamps used by miners, dentists, jewelers, surgeons or the like, it may be desirable to make similar changes. Further, in LED-based lighting fixtures or assemblies with multiple LEDs, LED sockets in accordance with the invention may be advantageously employed to allow individual LEDs or multiple chip LEDs to be easily replaced due to failure, the desire to change the brightness or color of the fixture, or the like. These examples are illustrative only, and it will be recognized that the teachings of the present invention may be employed in a wide variety of applications and contexts in which it is desired to easily remove one LED or a multiple chip LED and replace it with another.

Figure 1A:
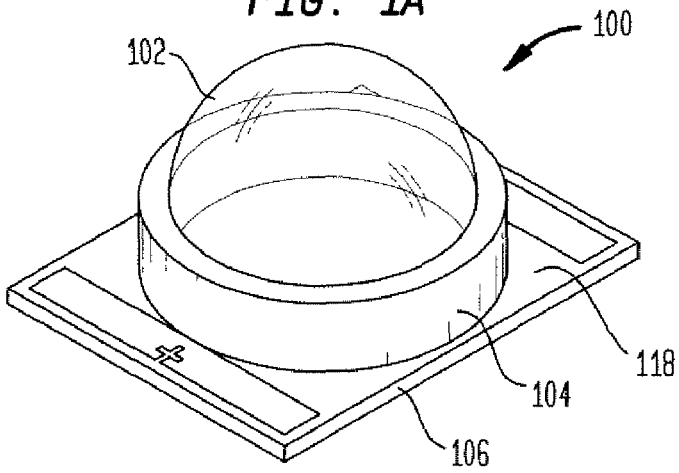
FIGS. 1A, 1B and 1C show a top perspective, a top, and a bottom view, respectively, of a typical prior art LED lamp suitable for mounting on a printed circuit board.
Figure 1B:
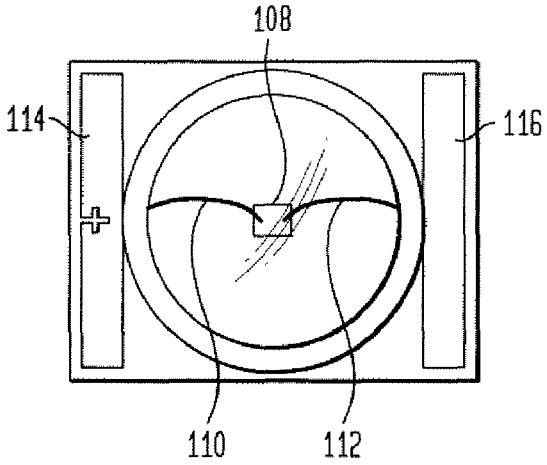
Figure 1C:
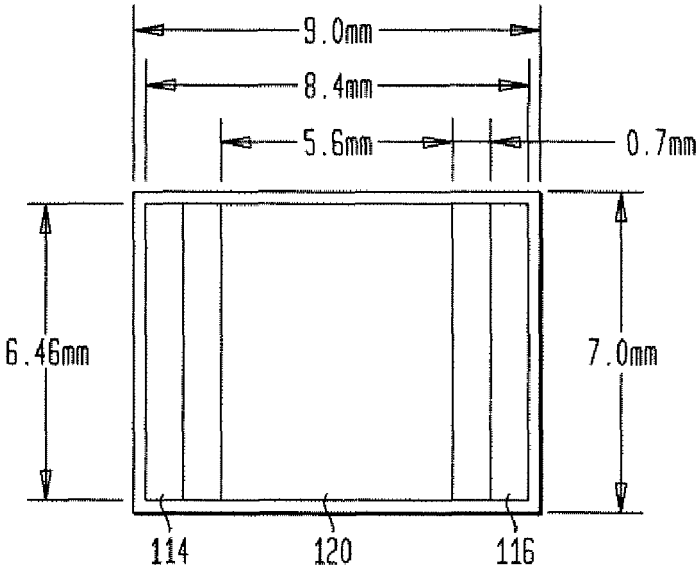

FIGS. 1A, 1B and 1C illustrate a standard LED packaging arrangement, such as that employed by the XLamp® 7090 XR-E series of LED products manufactured by Cree, Incorporated. As seen in FIG. 1A, a packaged LED lamp 100 comprises a lens 102, a reflector 104 and a mounting substrate 106. The arrangement 100 may also be referred to as an LED, LED lamp or a lamp. As seen in FIG. 1B, an LED chip 108 is electrically connected by bond wires 110 and 112 to electrical contact strips 114 and 116, respectively, on the substrate 106 which may suitably be a printed circuit board, such as a flame resistant 4 (FR4) board. When power is applied through the contacts 114 and 116, chip 108 emits light. The chip 108 is shown as having two top contacts for a chip having a horizontal arrangement. However, alternative LED chips and chip mounting arrangements are possible where the LED has a horizontal or vertical orientation or is flip chip mounted, as would be understood by one of ordinary skill in the art, and sockets in accordance with the invention may be adapted accordingly. Reflector 104 helps direct that emitted light upwards and the lens 102 focuses the emitted light. The chip 108 is thermally mounted on top surface 118 of substrate 106 with a thermal bonding paste. FIG. 1C shows a bottom surface 120 of the substrate 106 and electrical contacts 114 and 116 along with representative dimensions for the XLamp® 7090 XR-E series of LED products. It will be recognized that 9.0 mm is slightly smaller than 1 cm and is about ⅓ of an inch. As a result, it can be seen that the XLamp® LED products and other similar products have a small form factor compared to typical incandescent bulbs.

FIGS. 2A-2D illustrate one embodiment of a socket 200 in accordance with the present invention. In socket 200, tray 202 is supported by a spring 204 beneath four point contacts 206. When an LED lamp, such as lamp 100, is inserted into the top of tray 202, spring 204 biases the lamp contacts 108 and 110 against the socket point contacts 206. Socket 200 is designed for use in conjunction with an LED mounting arrangement, mount, or LED lamp, such as the lamp 100 of FIGS. 1A-1C. By way of example, if the substrate 106 has the outer dimensions of 9 mm×7 mm as shown in FIG. 1C, then tray 202 can have inner dimensions of slightly larger then 9 mm×7 mm where it is desired to hold the lamp 100 in place. However, tray or support 202 can have dimensions smaller than the LED lamp 100 depending on the embodiment. For example, a flat pusher plate smaller than the LED lamp bottom surface may be suitably employed. It will be recognized that smaller or larger trays can readily be designed for differently dimensioned LED lamps. Additionally, a tray insert can be employed to receive smaller LED lamps so that such lamps can be readily employed with the socket 200. A thermal paste may be employed to insure good thermal contact between a bottom surface, such as bottom surface 120, of a lamp, such as the lamp 100 and the top surface of the tray 202. As seen in the top view of socket 200 of FIG. 213, the top surface of tray 202 may suitably be copper on an FR4 board to provide thermal dissipation of heat generated by lamp 100. Alternatively, aluminum or some other heat dissipating material may be employed, or some other material may be employed having heat dissipating elements, such as paths or vias through and/or on the tray 200.

Figure 2A:
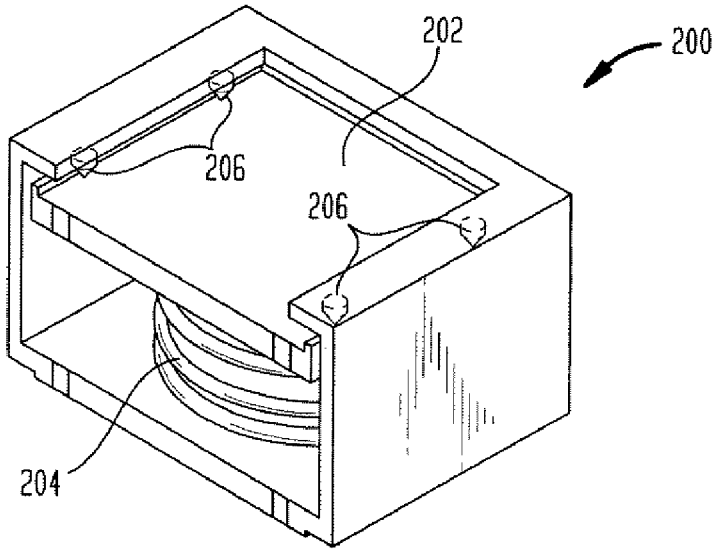
FIG. 2A shows a perspective view of a first embodiment of a socket for easily inserting and removing an LED lamp such as the one illustrated in FIGS. 1A-1C.
Figure 2B:
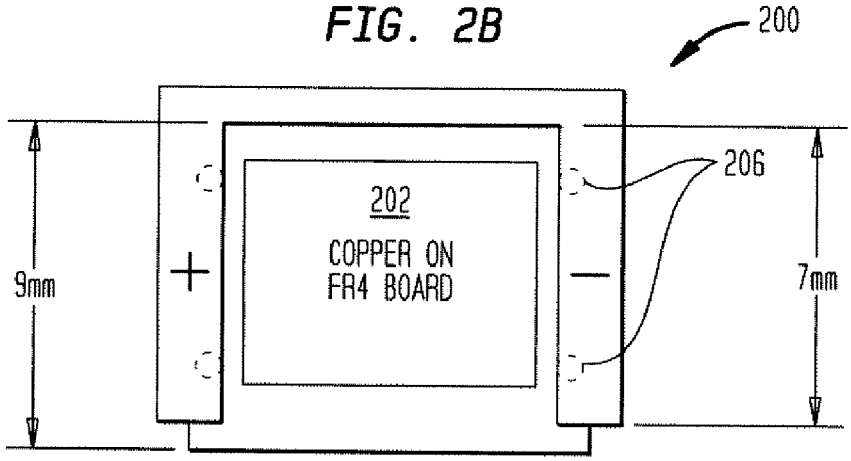
FIG. 2B shows a top view without an LED in place in the socket.
Figure 2C:
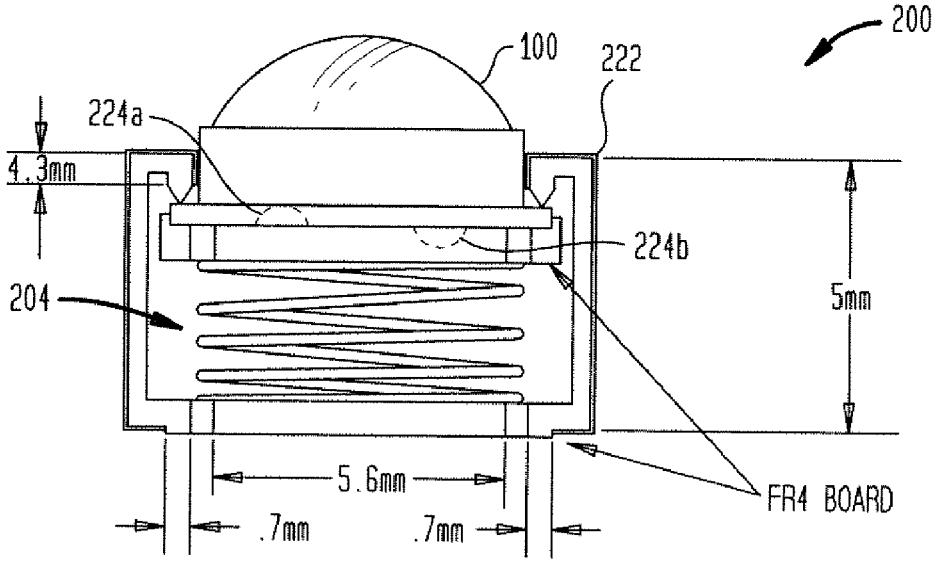
FIG. 2C shows a side view of that socket with an LED, such as the one shown in FIGS. 1A-1C, in place.
Figure 2D:
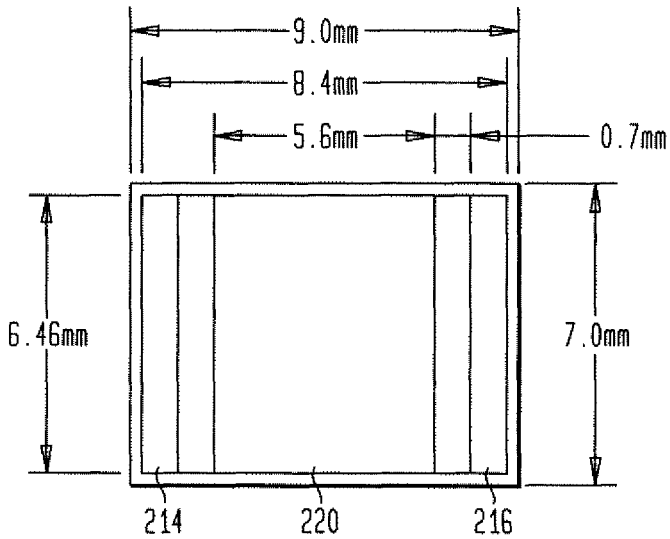
FIG. 2D shows a view of the bottom mounting surface of the socket.

FIG. 2C shows socket 200 with lamp 100 in place, and FIG. 2D shows details of bottom surface 215 of the socket 200. As seen in FIG. 2D, the bottom surface 220 may preferably be identical to the bottom surface of LED lamp 100 with corresponding contact strips 214 and 216 so that the socket 200 with the lamp 100 may be a direct manufacturing replacement for a standalone lamp 100 in applications where it is desired to be able to readily replace the lamp 100 by hand without the use of tools, the application of heat or the like. In such an embodiment, the socket 200 with lamp 100 in place can be supplied in bulk in a paper tape reel. While socket 200 is shown in FIG. 2D as having a bottom surface 220 identical to bottom surface 120 of LED lamp 100, it will be recognized that other bottom mounting surfaces may be suitably employed for other applications and contexts as desired.

As further seen in FIG. 2C, socket 200 may further include an optional non-conductive coating 222 on the outer surfaces of point contacts 206. Such a coating may be desirable where a collar 104 is a conductive material such as aluminum, or the exterior of socket 200 is in close proximity to other components or any item which could short the contacts. Also, support or tray 202 can optionally include profusions and/or recesses, such as protrusion 224*a* or recess 224*b*, which help align or hold the lamp 100 in place by mating with corresponding recesses and/or protrusions on the lamp 100. Protrusion(s) and/or recess(es) can be integrated with or part of the contact structure on the lamp 100 and the socket 200 to help align and maintain electrical contact for powering the lamp 100.

As an example of how a first LED lamp, such as lamp 100, can be readily replaced with a second of similar dimension, a user can depress tray 202 with his or her finger, remove the first LED lamp by sliding it out, and slide the second lamp into place. After removing his or her finger, the spring 204 acts to bias the contacts of the second lamp up into good electrical contact with the point contacts 206. While tray 202 of socket 200 is shown with an open front face to ease the sliding in and out of LED lamps, it will be recognized that a front face can be added in applications where it is desired to make sure the LED mount cannot slide forward when in use.

Figure 3:
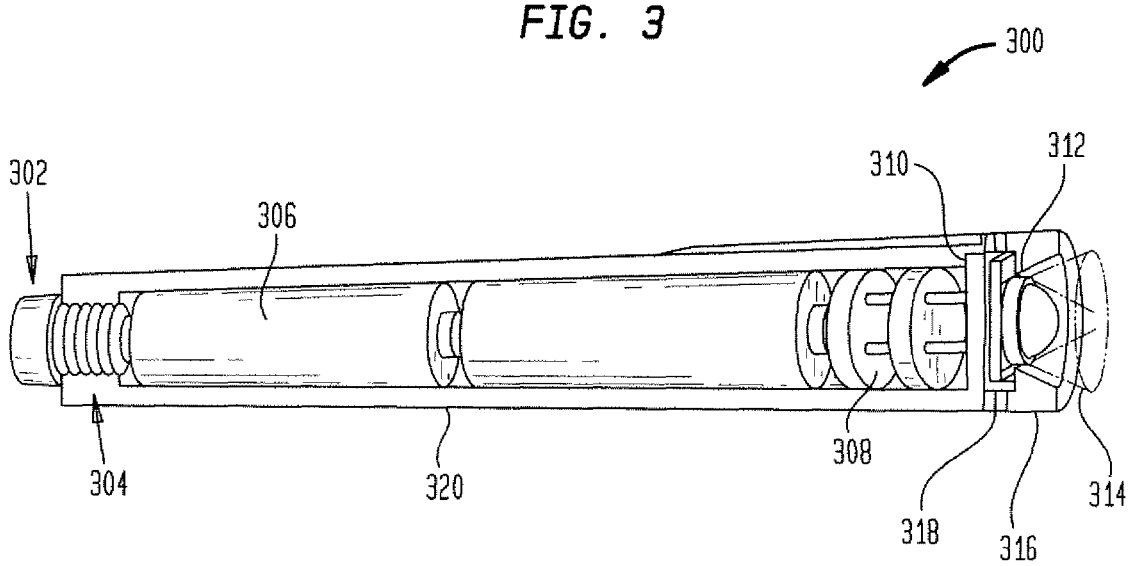
FIG. 3 shows a portable battery operated light or flashlight employing a socket in accordance with the present invention.

FIG. 3 shows a cutaway view of a battery powered portable personal light or flashlight 300 employing a socket such as the socket 200 of FIG. 2 or any one of the sockets 400, 500, 600, 700, 800, 900, or 1000 of FIGS. 4-10, respectively. Flashlight 300 comprises an on off switch 302, a spring 304, batteries 306, a driver 308, a socket 310, LED lamp 312 and a secondary optic element 314. A threaded collar 316 can be removed by rotation and then replaced by counter rotation onto threads 318 on a sleeve of body 320 of the flashlight 300 in a known fashion to provide access to the LED lamp 312 and the socket 310 so that the LED 312 may be readily replaced.

Figure 4A:
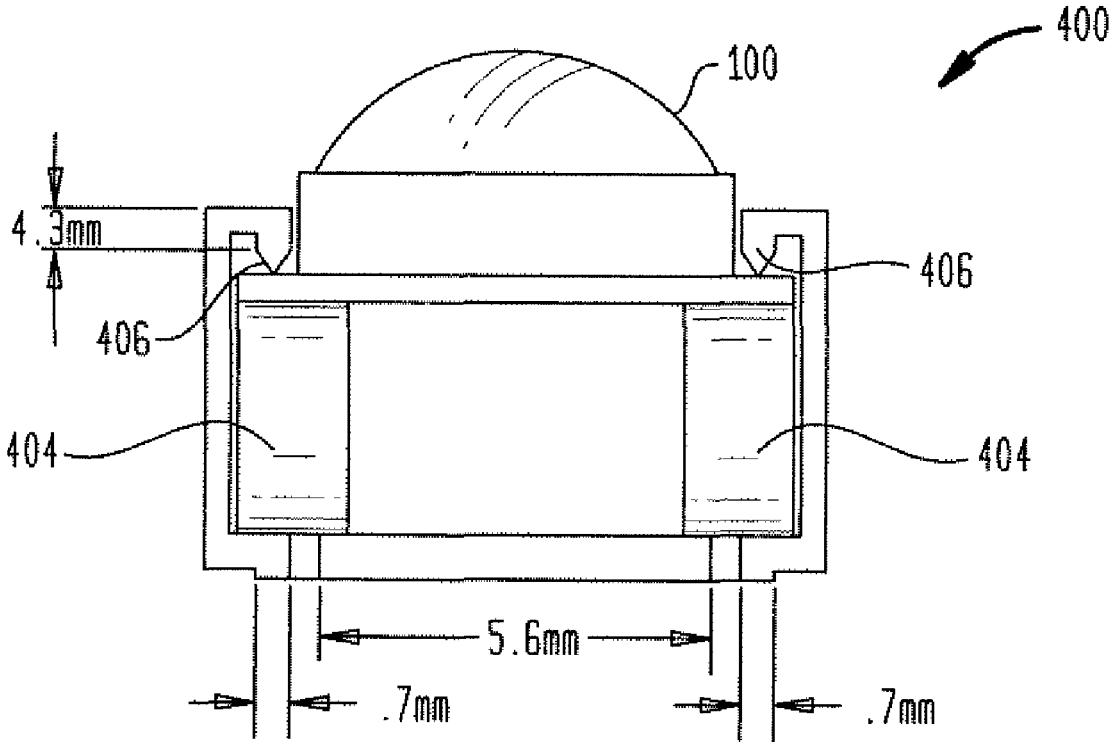
FIG. 4A shows a side view of a second embodiment of a socket employing an alternative spring arrangement.
Figure 4B:
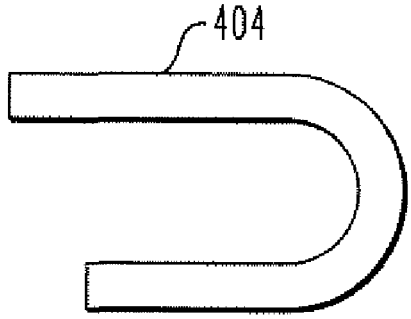
FIG. 4B shows further details of the alternative spring.

FIGS. 4A and 4B show details of a socket 400 in accordance with the present invention. As seen in the side view of FIG. 4A, an LED lamp, such as the lamp 100 of FIG. 1 is inserted in the socket 400. Point contacts 406 contact the contacts 114 and 116 (not shown in FIG. 4) of lamp 100. The embodiment of FIG. 4A is similar to that shown in FIGS. 2A-2D except an alternative spring clip 404 replaces the spring 204 of FIGS. 2A-2D as the mechanism to bias the contacts 406 against the contacts 114 and 116. In socket 400, the spring clip 404 has portions arranged on opposite sides of the socket 400. The spring clip 404 biases contacts 406 of socket 400 to make good electrical contact with contacts 114 and 116 of LED 100.

Figure 5A:
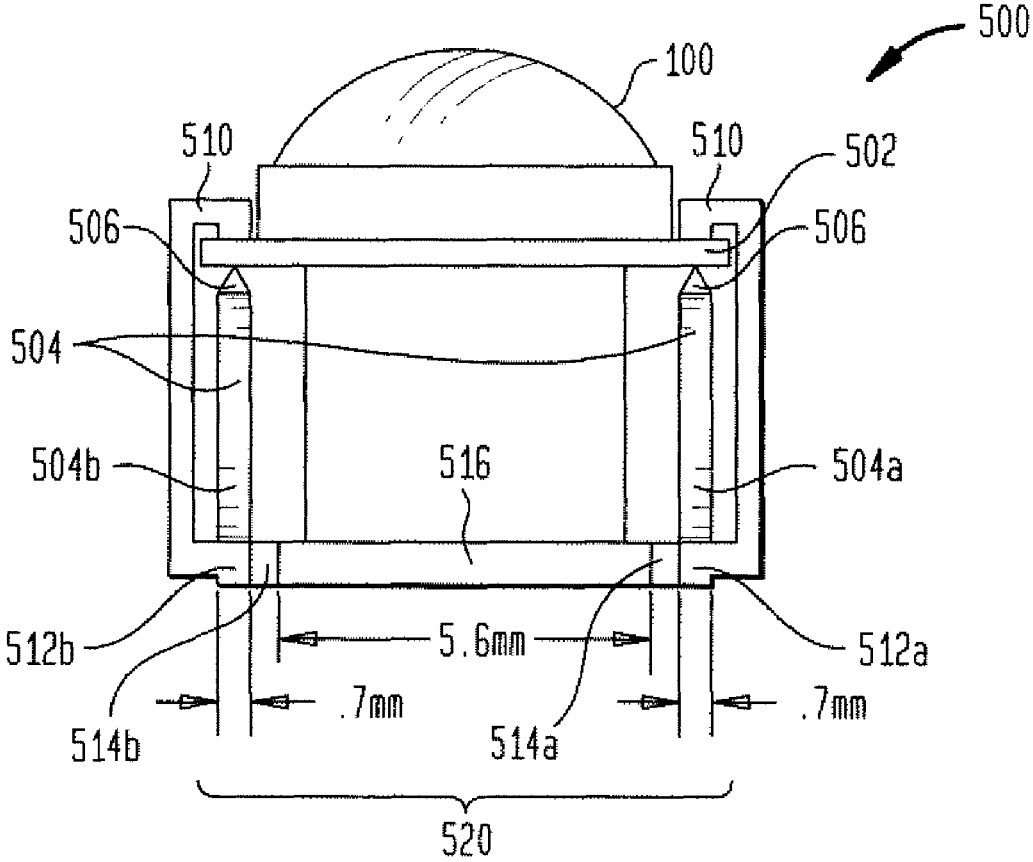
FIG. 5A shows a side view of a third embodiment of a socket employing a bottom contacting arrangement.
Figure 5B:
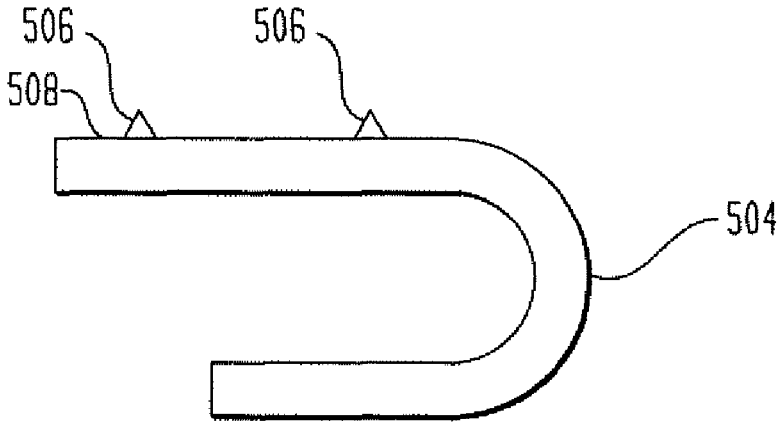
FIG. 5B shows further details of a spring with contacts for use therein.

FIGS. 5A and 5B show details of a socket 500 in accordance with a further embodiment of the present invention. As seen in the side view of FIG. 5A, a bottom contact arrangement is employed to make contact with contacts, such as the contacts 114 and 116 on the bottom surface 120 of the LED 100 which is shown in place in socket tray 502 of the socket 500. As seen in FIGS. 5A and 5B, a clip spring 504 has point contacts 506 on its top surface 508 as seen in FIG. 5B. Spring 504 biases top surface of LED lamp 100 against the undersides of ribs 510 of socket 500 and its contacts 506 make electrical contact with bottom contacts 114 and 116 of lamp 100. Spring 504 has two sides 504*a* and 504*b* which are electrically isolated from one another and which make electrical contact through contacts 512*a* and 512*b* in bottom 520 of the socket 500. Contacts 512*a* and 512*b* are electrically isolated from one another and from a conductive pad 516 by insulator strips 514*a* and 514*b*.

Figure 6A:
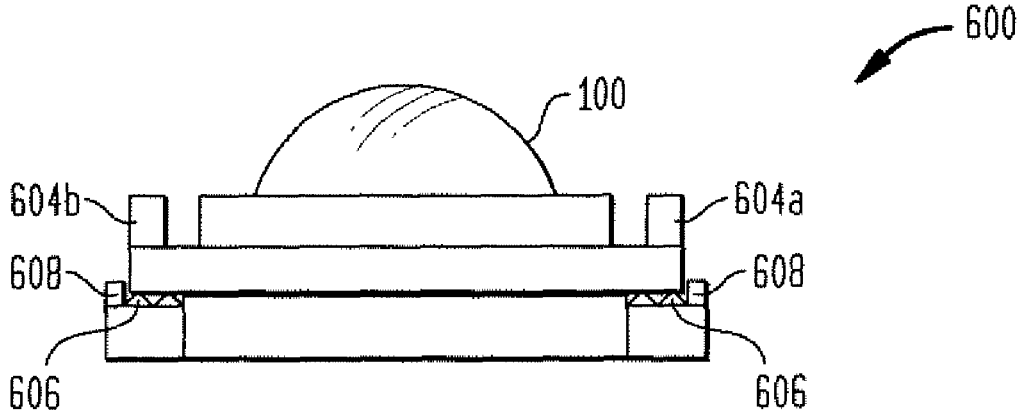
FIGS. 6A, 6B and 6C show front and side views of a fourth embodiment of a socket.
Figure 6B:
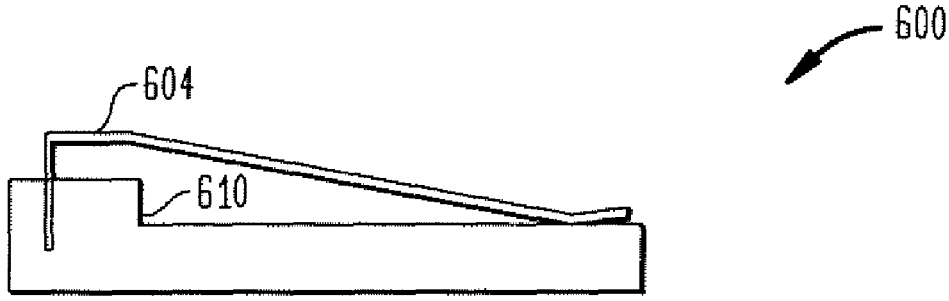
Figure 6C:
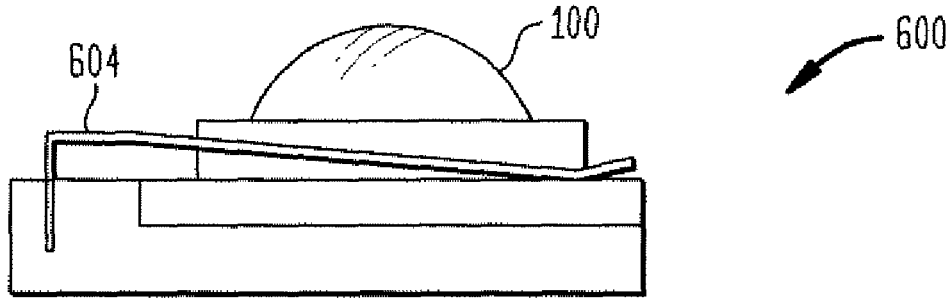

FIGS. 6A, 6B and 6C illustrate aspects of a socket 600 in accordance with a further aspect of the invention. FIG. 6A shows a front view of the socket 600 with an LED, such LED 100 of FIG. 1 mounted in place. FIG. 6B shows a side view of the socket 600 with no LED and FIG. 6C shows a side view with LED 100 in place. Like FIGS. 5A and 5B, FIGS. 6A-6C show a bottom contact arrangement. However, as seen in FIG. 6A, two spring clips 604*a* and 604*b* (collectively 604) bias the LED lamp 100 downwards so that lamp bottom contacts 114 and 116 are biased against socket contacts 606. Raised sides 608 seen in FIG. 6A and back stop surface 610 seen in FIG. 6B define a tray holding LED lamp 100 in place. In certain embodiments of the present invention, the retaining mechanism, such as clips 604 can act as the socket contacts that contact for that lamp. For example, this embodiment could readily be modified so that clips 604 contact the top contacts of lamp 100 and serve the dual role of providing electrical contact.

Figure 7A:
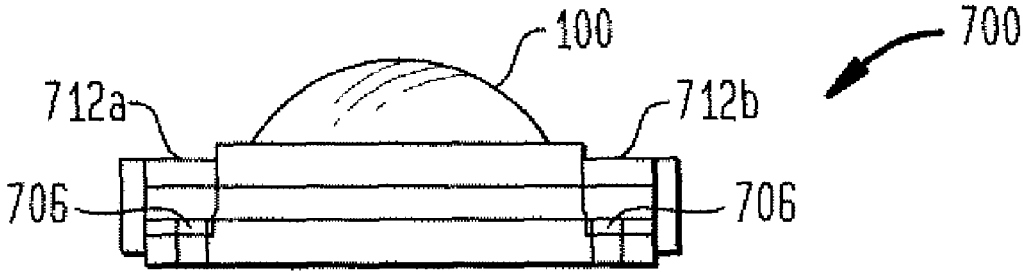
FIGS. 7A and 7B show front and side views of a fifth embodiment of a socket employing a clamp and lock arrangement.
Figure 7B:
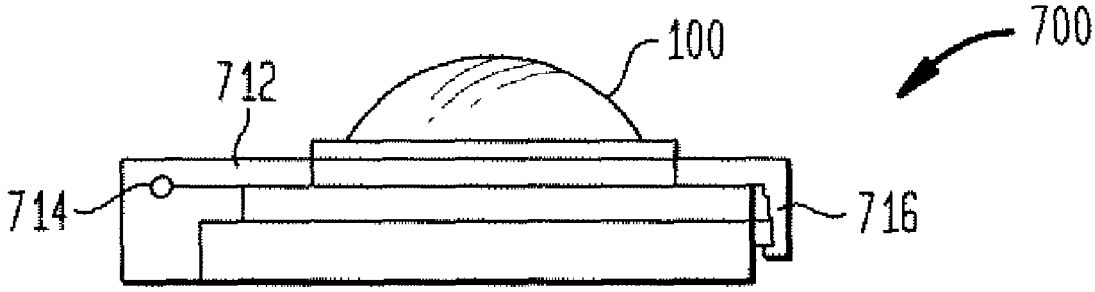

FIGS. 7A and 713 show details of a clamp socket 700 in accordance with a further embodiment of the present invention. FIG. 7A shows a front view and FIG. 7B shows a top view of socket 700. As in FIGS. 6A-6C, a bottom contact arrangement is shown in FIGS. 7A and 7B in which bottom LED contacts 114 and 116 are biased against socket contacts 706. In FIGS. 7A and 7B, hinged arms 712*a* and 712*b* (collectively 712) rotate about hinges 714 and lock arms 716 hold the arms in place so they serve to clamp LED lamp 100 against the socket contacts 706. Using a finger, a user can easily unsnap the lock mechanism and open the arms to replace the lamp 100 as desired.

Figure 8A:
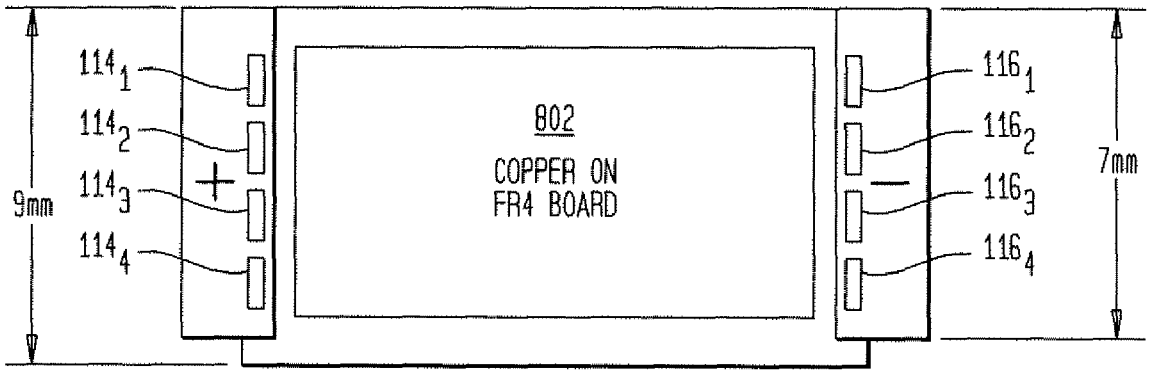
FIGS. 8A and 8B show top and side views of a sixth embodiment of a socket for a multiple chip LED.
Figure 8B:
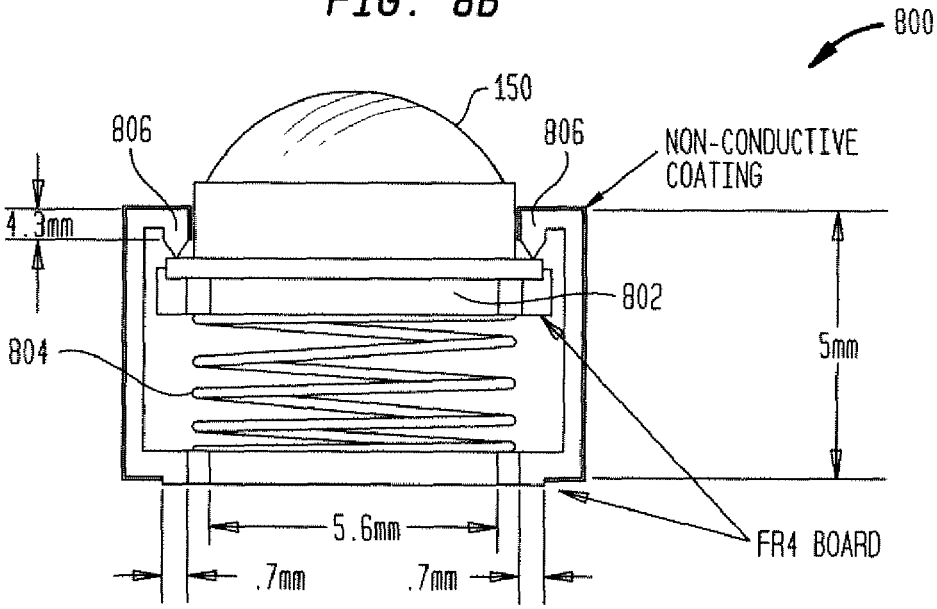

FIGS. 8A and 8B show details of a socket 800 which is an adaptation of the socket 200 of FIG. 2 for use with an LED lamp having multiple LED chips, such as lamp 150 which has four white chips or a red, green, blue and a white chip. While a four chip embodiment is illustrated as exemplary, it will be recognized that the invention can be adapted to any variation of a single or multiple chip LED lamp as desired.

FIG. 8A shows a top view of the socket 800 in which top surface of tray 802 may suitably be copper on an FR4 board to provide thermal dissipation of heat generated by the multiple chips of lamp 150. As seen in FIG. 8A, because of the multiple chips of LED lamp 150, that lamp has four sets of electrically isolated contacts $\mathbf{114}_{1\text{-}4}$, and $\mathbf{116}_{1\text{-}4}$, respectively, with one set for each chip. As a result, socket 800 has four electrically isolated sets of contacts $\mathbf{806}_1$, $\mathbf{806}_2$, $\mathbf{806}_3$, and $\mathbf{806}_4$, (collectively 806) spaced to correspond with and make contact with the corresponding sets of contacts of LED lamp 150. As such, the different LED chips of the multiple LED lamp 150 can be individually or selectively activated or addressable.

In socket 800, tray 802 is supported by a spring 804. As seen in FIG. 8B, when an LED, such as LED lamp 150 is inserted in tray 802, its contacts $\mathbf{114}_{1\text{-}4}$ and $\mathbf{116}_{1\text{-}4}$ are biased against the corresponding electrical contacts 806 of socket 800.

Figure 9A:
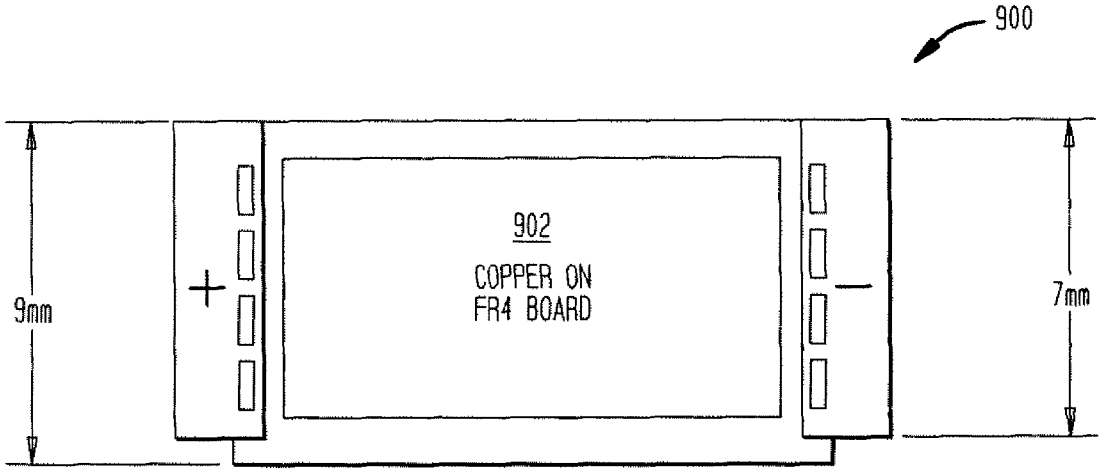
FIGS. 9A and 9B show top and side views of a seventh embodiment of a socket for a multiple chip LED.
Figure 9B:
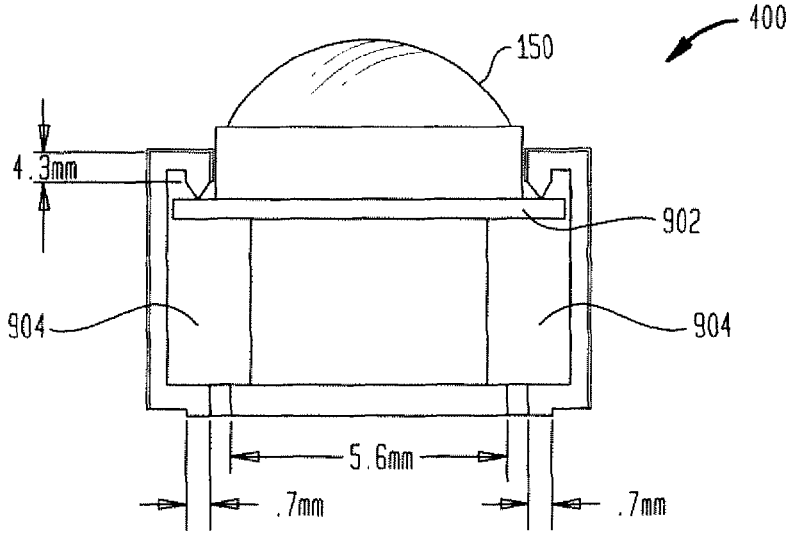

FIGS. 9A and 9B show details of a socket 900 which is an adaptation of the socket 400 of FIG. 4 for use with a multiple chip LED lamp, such as lamp 150. FIG. 9A shows a top view of the socket 900 in which top surface of a lamp supporting tray 902 may suitably be copper on an FR4 board. Again, because of the multiple chips of LED lamp 150, there are four sets of electrical contacts $\mathbf{114}_{1\text{-}4}$ and $\mathbf{116}_{1\text{-}4}$, respectively with one set for each chip. Socket 900 has four electrically isolated sets of contacts $\mathbf{906}_1$, $\mathbf{906}_2$, $\mathbf{906}_3$, and $\mathbf{906}_4$ (906 collectively) spaced to correspond with and make contact with the corresponding sets of contacts of the LED lamp 150. In the socket 900, tray 902 is supported by a clip spring 904. As seen in FIG. 9B, when an LED, such as LED lamp 150, is inserted in tray 902, its contacts $\mathbf{114}_{1\text{-}4}$ and $\mathbf{116}_{1\text{-}4}$ are biased against the corresponding electrical contacts 906.

Figure 10A:
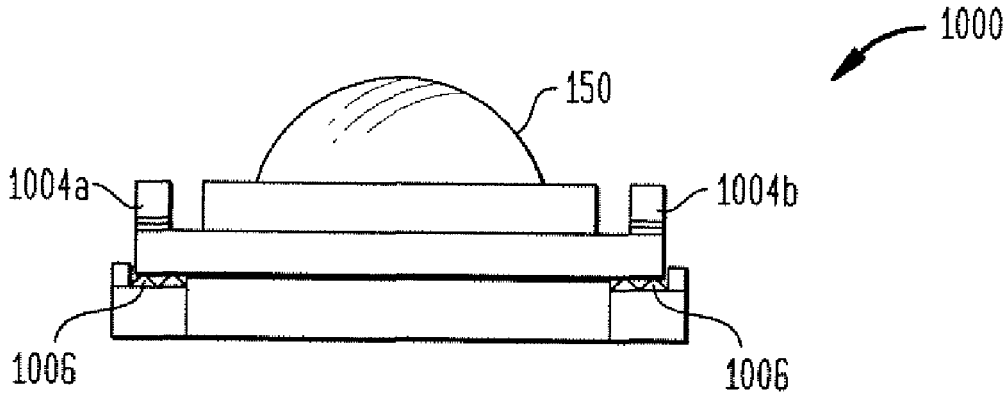
FIGS. 10A, 10B, and 10C show front, top and side views of an eighth embodiment of a socket for a multiple chip LED.
Figure 10B:
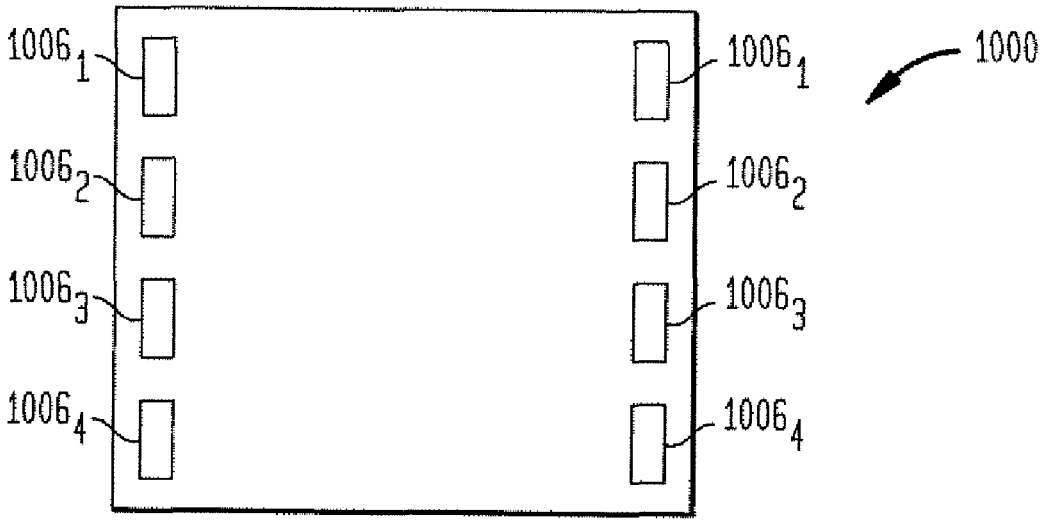
Figure 10C:
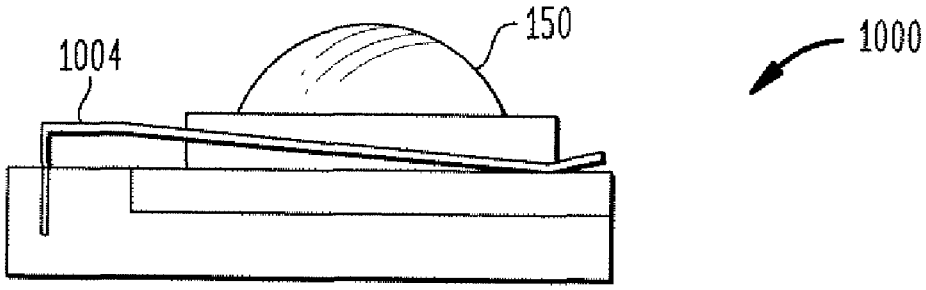

FIGS. 10A-10C show details of a socket 1000 which is an adaptation of the socket 600 of FIGS. 6A-6C. FIG. 10A shows a front view of the socket 1000 with LED lamp 150 clipped in place by clip springs 1004*a* and 1004*b* (collectively 10004). FIG. 10B shows a top view of socket 1000 without LED 150 in place in which four sets of electrical point contacts $\mathbf{1006}_{1\text{-}4}$ (collectively 1006), respectively, of lamp 150 are seen. FIG. 10C shows a side view of socket 1000. When LED lamp 150 is in place, the side clip springs 1004 bias its bottom contacts against the point contacts 1006 as seen in FIG. 10A.

Figure 11:
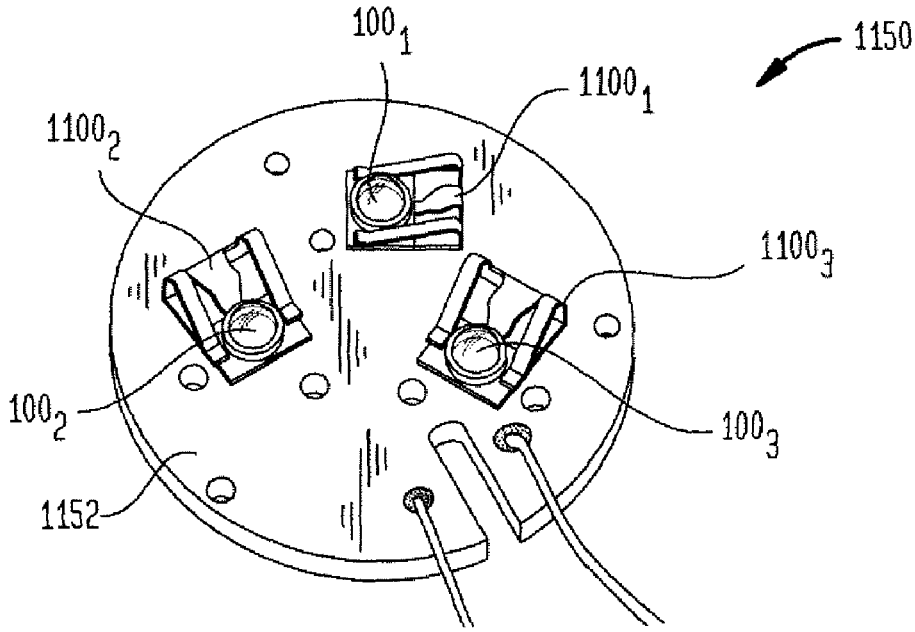
FIG. 11 shows a first exemplary LED-based lighting fixture with multiple LEDs and a plurality of sockets in accordance with the present invention.

FIG. 11 shows a first LED-based lighting fixture or assembly 1150 with multiple LED lamps $\mathbf{100}_1$, $\mathbf{100}_2$ and $\mathbf{100}_3$ (collectively 100) in multiple sockets $\mathbf{1100}_1$, $\mathbf{1100}_2$ and $\mathbf{1100}_3$ (collectively 1100). The multiple sockets are physically mounted and electrically connected on a circuit board 1152, such as a flame resistant 4 (FR4) board with thermal vias of resin epoxy reinforced with woven fiberglass or a metal core printed circuit board (MCPCB). Suitable MCPCBs may be made out of aluminum, copper or any other good thermal conductor with aluminum presently being the most common. Electrical power is supplied to the sockets $\mathbf{1100}_1$, $\mathbf{1100}_2$ and $\mathbf{1100}_3$ in a known manner, and the combination of the printed circuit board, sockets and LEDs forms an LED lighting module. In such modules, the ability to releasably mount LEDs as taught herein provides an improved ability to cost effectively replace and change LEDs which is expected to be beneficial in a host of applications as LEDs replace other light sources. While the sockets 1100 shown are similar to the type illustrated in detail in FIGS. 6A-6C, it will be recognized that sockets similar to the sockets 200, 400, 500 or 700 of FIGS. 2A-2D, 4A and 4B, 5A and 5B or 7A and 7B could also be suitably employed with LED lamps 100, and that sockets, such as sockets 800, 900 or 1000 could be suitable employed with multichip LED lamps, such as the lamp 150. Further variations could readily be developed based upon the teachings herein to provide LED-based lighting fixtures with the flexibility of easily swapping or replacing LED lamps.

Figure 12:
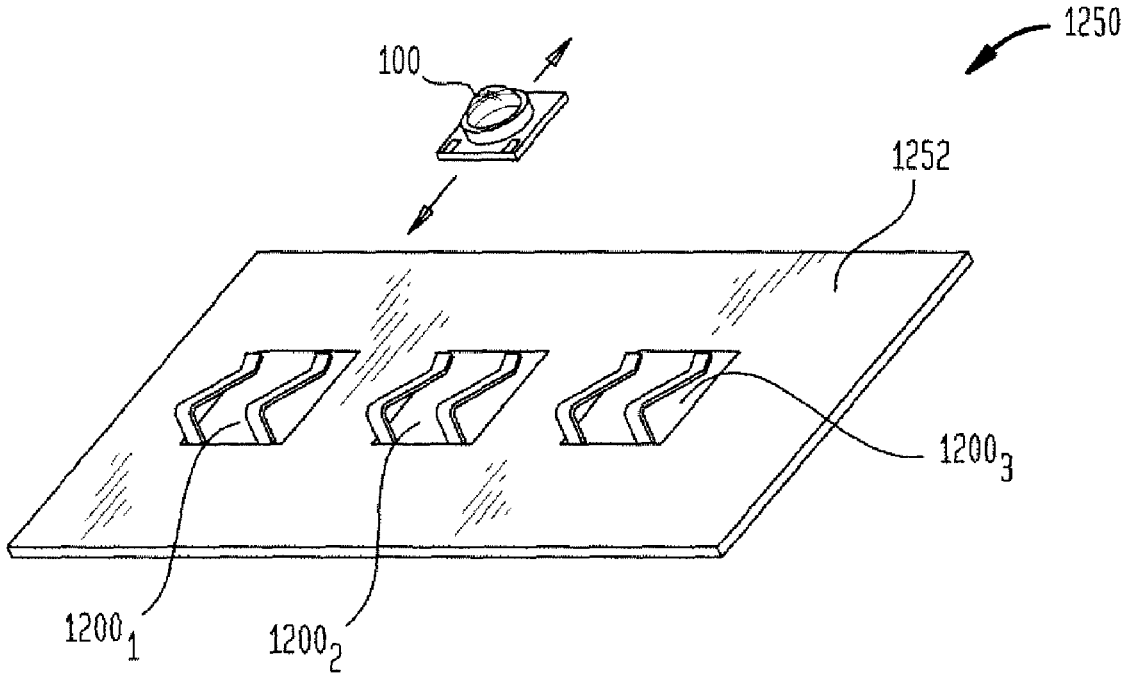
FIG. 12 shows a second exemplary LED-based lighting fixture with multiple LEDs and a plurality of sockets in accordance with the present invention.

FIG. 12 shows a second LED-based light fixture or assembly 1250 for multiple LED lamps. A single LED lamp 100 is shown to illustrate how LED lamps could be readily slid into place or removed from the plurality of sockets $\mathbf{1200}_1$, $\mathbf{1200}_2$, $\mathbf{1200}_3$ on board 1252.

Figure 13A:
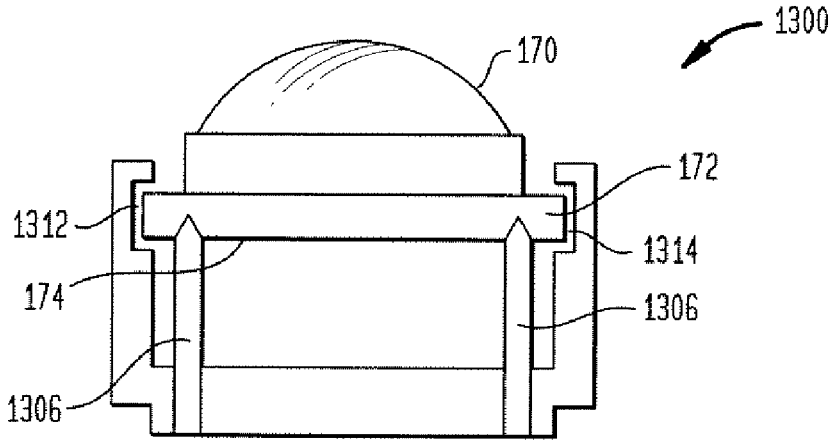
FIGS. 13A, 13B, 14A and 14B show further illustrative alternative embodiments.

FIG. 13A shows a further socket 1300 in which end portions of substrate 172 of modified LED lamp 170 slide into recesses 1312 and 1314 of the socket 1300. Alternatively, tongues in the sidewalls of socket 1300 and/or substrate 172 may slide into mating grooves in the ends of the substrate 172 and/or socket 1300 with substrate 172 and/or substrate 172 being modified to include such grooves. As further seen in FIG. 13A, bottom 172 of substrate 172 has grooves which slide onto contacts 1306 of socket 1300.

Figure 13B:
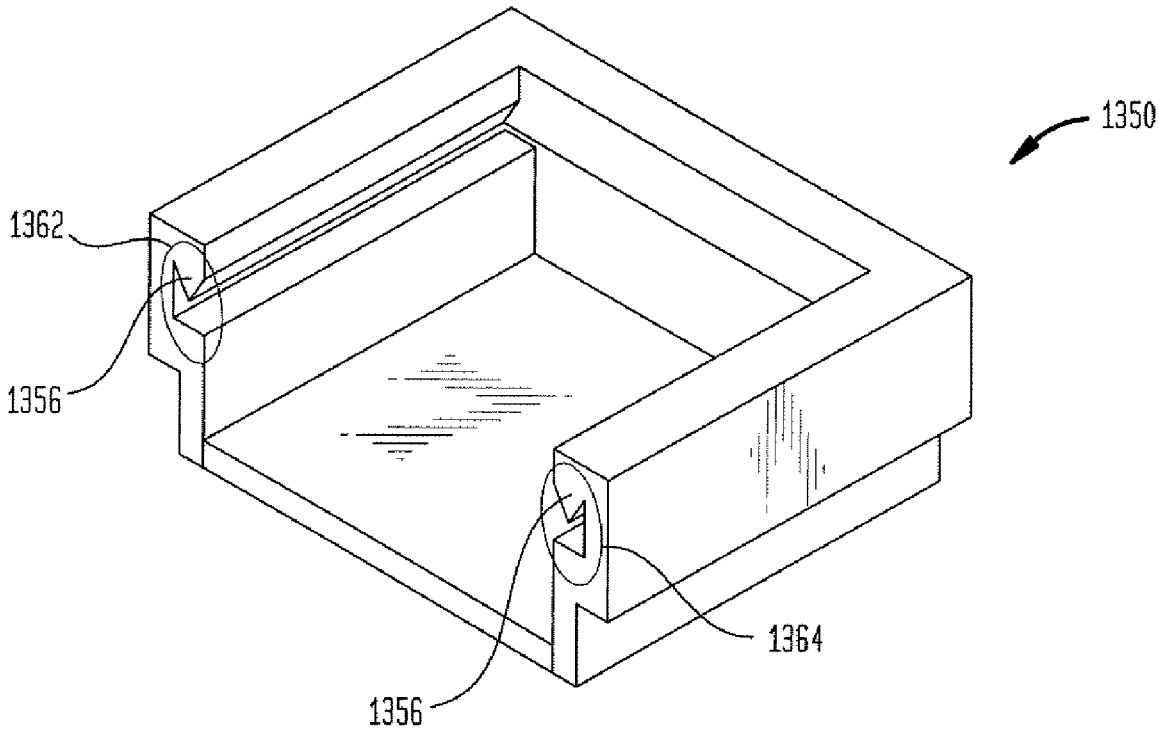

FIG. 13B shows a further socket 1350 in which contacts 1356 are formed as an integral part of recesses or grooves 1362 and 1364 which receive end portions of a substrate of an LED lamp (not shown).

Figure 14A:
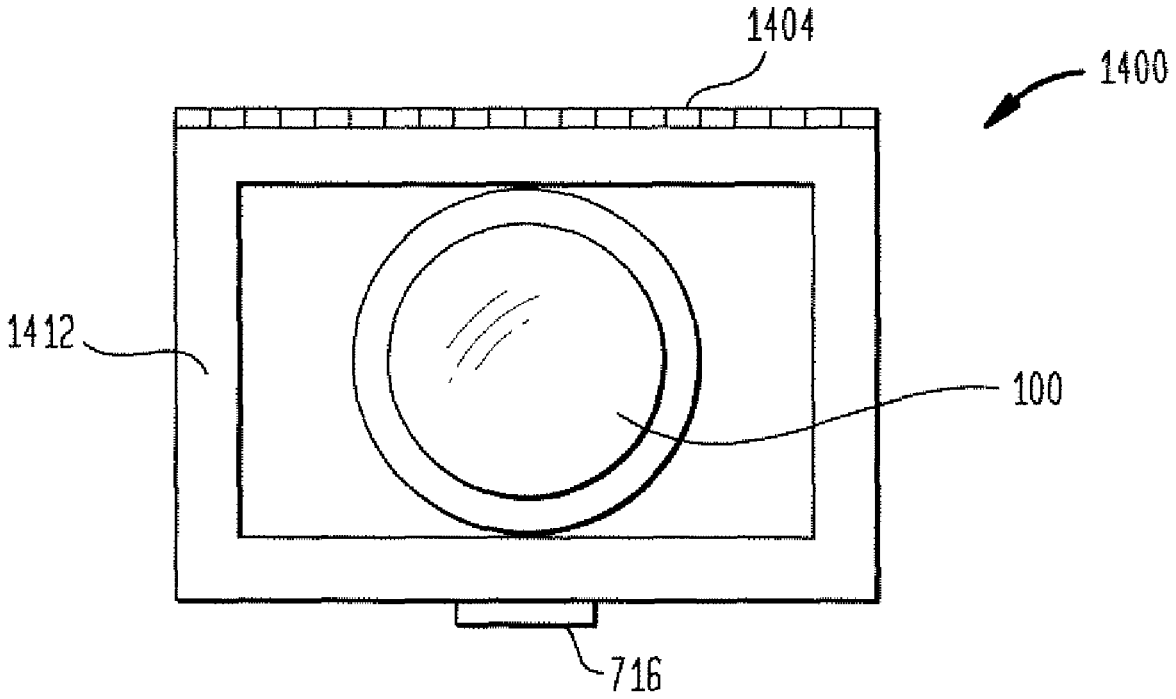
Figure 14B:
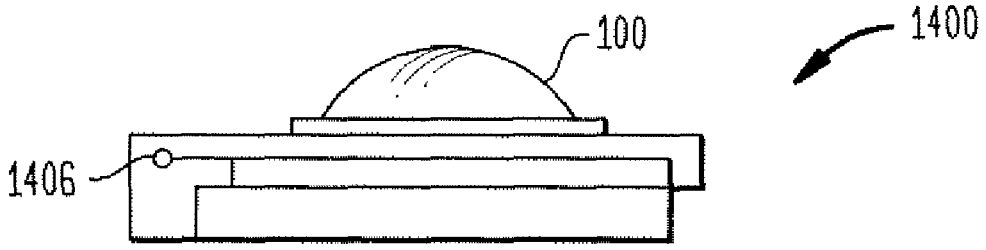

FIGS. 14A and 14B show a socket 1400 which is an adaptation of the socket 700 of FIGS. 7A and 7B in which rather than employing two arms 712*a* and 712*b*, a hinged window frame member 1412 rotates around a hinge 1404 and releasably locks with a releasable locking mechanism 716.

Figure 15A:
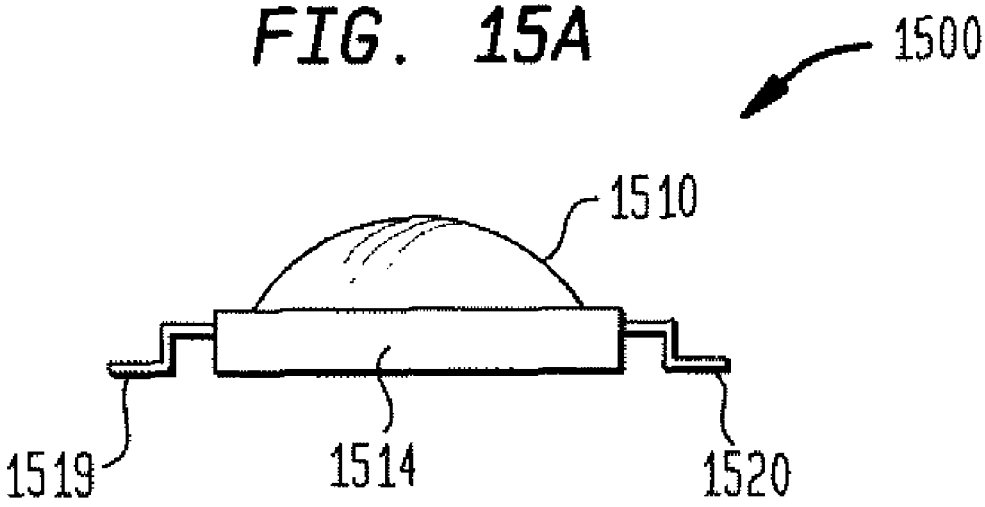
FIG. 15A shows a top view of a socket for easily inserting and removing an LED lamp such as the one illustrated in FIGS. 14A and 14B without the LED lamp in place.
Figure 15B:
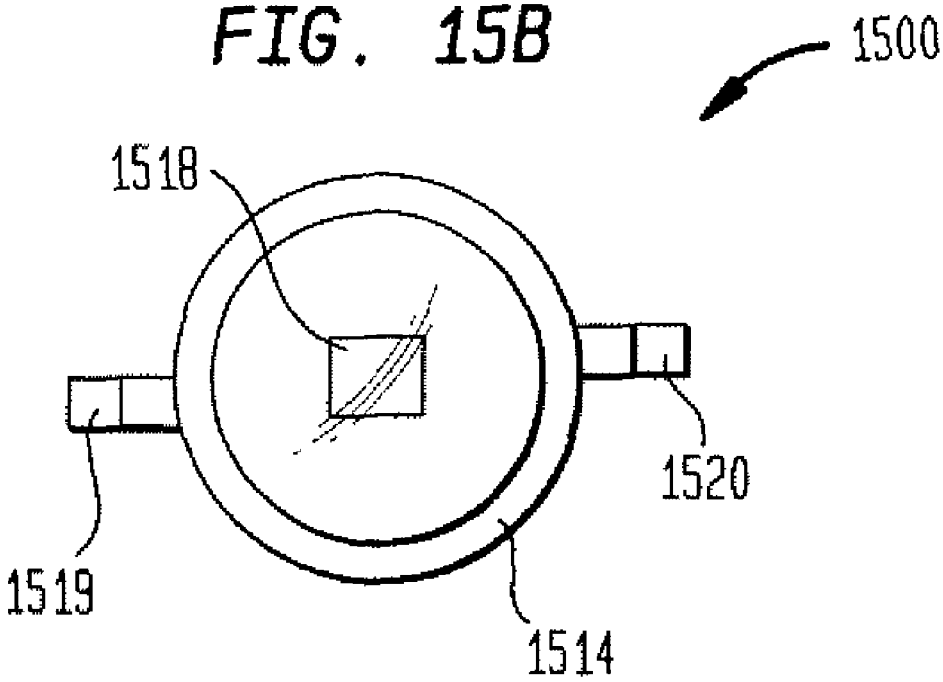
FIG. 15B shows a side view of that socket with the LED lamp in place.

FIGS. 15A and 15B illustrate a second standard LED packaging arrangement which is referred to as a lead frame LED lamp. As seen in FIGS. 15A and 15B, a packaged LED lamp 1500 comprises a lens 1510, a reflector package 1514, and a photonic chip 1518 connected (connection not shown) to electrical leads 1519 and 1520. As seen in FIG. 15B, the electrical leads 1519 and 1520 are offset with respect to one another.

Figure 16A:
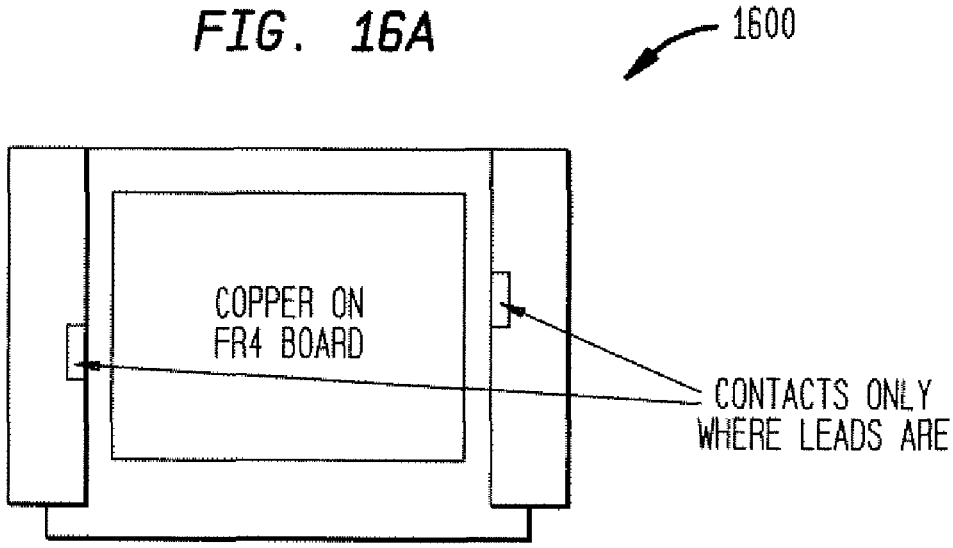
FIGS. 16A and 16B show front and side views of a further embodiment of a socket employing a clamp and lock arrangement for use with an LED lamp like that of FIGS. 14 A and 14B.
Figure 16B:
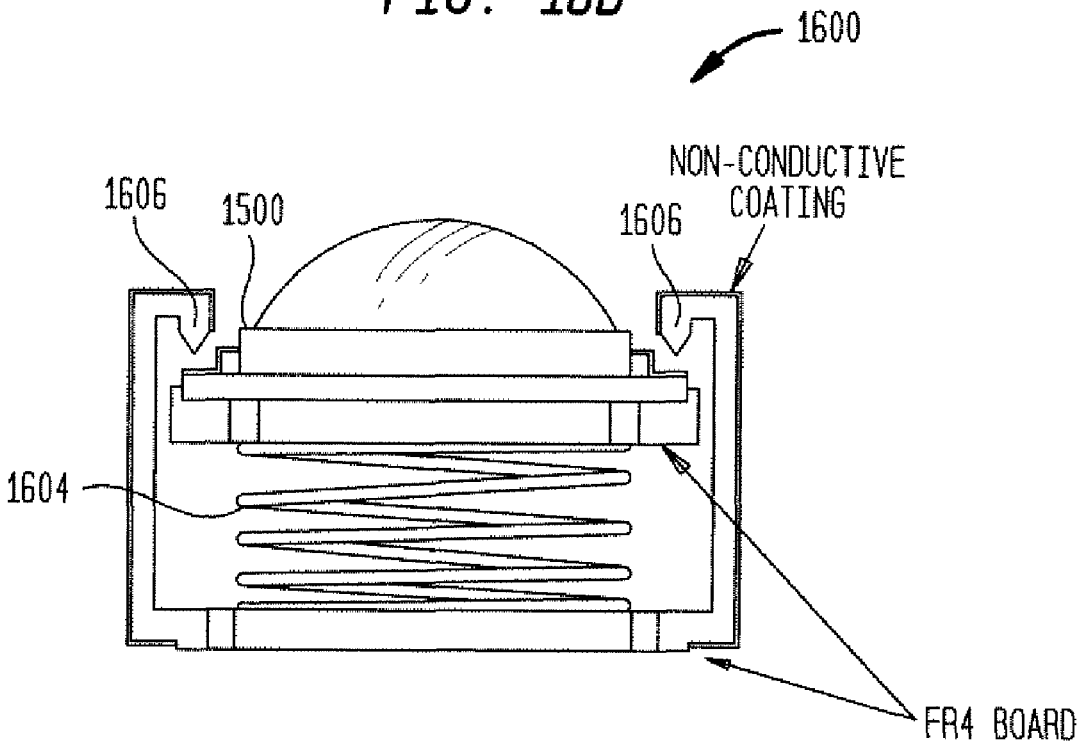

FIGS. 16A and 16B illustrate a socket 1600 in accordance with a further embodiment of the present invention. Socket 1600 is suitable for use in conjunction with lamp 1500. In socket 1600, tray 1602 is supported by a spring 1604 beneath two contacts 1606 arranged to correspond with leads 1519 and 1520, respectively. When an LED lamp, such as lamp 1500, is inserted into the top of tray 1602, spring 1604 biases the lamp leads 1519 and 1520 against the socket contacts 1606. The contacts on the socket 1600 can be in positions corresponding to the positions of the leads on the lamp 1500 or can be designed to accommodate multiple lead frame configurations.

Figure 17A:
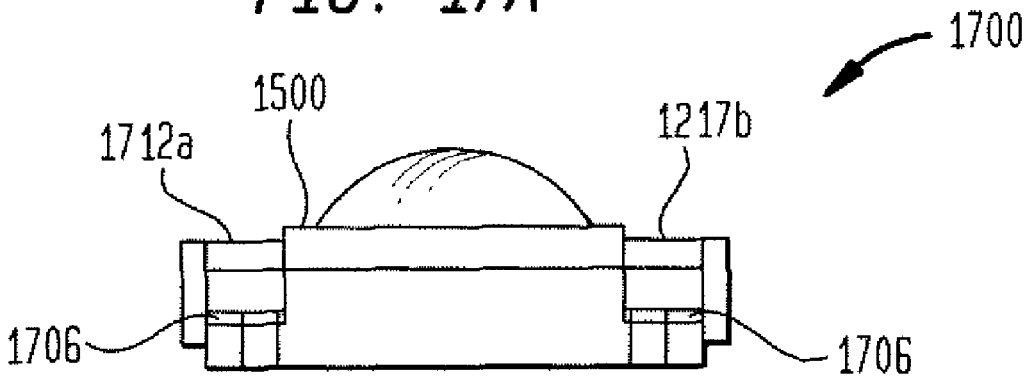
FIGS. 17A and 17B show front and side views of a clamp socket in accordance with a further embodiment of the invention.
Figure 17B:
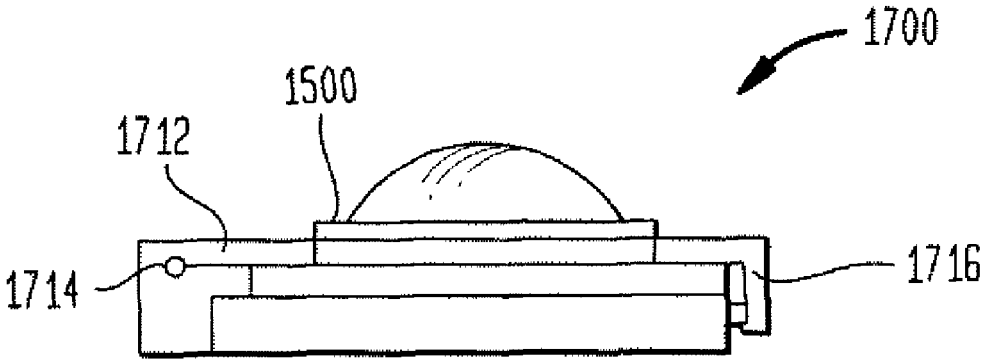

FIGS. 17A and 17B show details of a clamp socket 1700 in accordance with a further embodiment of the invention. FIG. 17A shows a front view and FIG. 17B shows a side view of socket 1700. A bottom contact arrangement is shown in which socket contacts 1706 make contact with the bottoms of leads 1519 and 1520 of lamp 1500. In FIGS. 17A and 17B, hinged arms 1712*a* and 1712*b* (collectively 1712) rotate about hinges 1714 and lock arms 1716 hold the arms in place so as to clamp leads 1519 and 1520 against the socket contacts 1706. Using a finger, a user can easily unsnap the lock mechanism and open the arms to replace the lamp 1500 as desired.

While the present invention has been discussed above in the context of several illustrative embodiments, it will be recognized that a wide variety of LED sockets may be designed in accordance with the teachings of the present invention above and the claims which follow below. For example, utilizing such teachings, various further socket arrangements for releasably making and maintaining electrical contact with an LED lamp may employ a wide variety of retaining, aligning, electrical contact and/or guiding structures to enable the LED socket and LED lamp to engage or disengage their contacts. While exemplary approaches have been shown, other guides, channels, lips, ridges, bumps, recesses and/or protrusions on the lamp, the socket or both may be readily designed that make use of various individual aspects of the described embodiments to suit a particular design application or context. Additionally, the LED sockets can be designed to accommodate various LED lamp and/or contact configurations. Similarly, while illustrative backing mechanisms are shown and described herein, it will be appreciated that snaps, latches, compression fits, screws or holes that go through the retaining mechanism and the lamp to hold the lamp in place may be suitably employed. Further, it will be recognized that other suitable arrangements may be readily developed and may be necessary if LED contacts different from those illustrated are employed. While various springs, clamps, locking mechanisms and the like are illustrated, it will be recognized that other mechanical equivalents can be employed to the end of maintaining good contact while allowing ready release.

We claim:

1. A socket for releasably mounting a packaged LED lamp comprising a lens and at least one LED chip mounted on a mounting substrate having electrical contacts, the socket comprising:

socket power contacts for contacting the electrical contacts on the mounting substrate of the LED lamp and supplying power to the LED chip; and a mechanism for maintaining said socket power contacts in electrical contact with said electrical contacts during operation and for allowing the LED lamp to be readily removed and replaced by hand when it is desired to replace the LED lamp.

2. The socket of claim 1 wherein said mechanism for maintaining said socket power contacts in electrical contact with said lamp power contacts comprises a spring biased tray which can be depressed with finger pressure to replace the LED lamp, and which when not depressed provides a spring force to bias said socket power contacts against the lamp power contacts of an LED lamp in said tray.

3. The socket of claim 2 wherein the spring biased tray has an inner dimension slightly greater than an outer dimension of a base of the LED lamp.

4. The socket of claim 1 wherein the packaged LED lamp further comprises a reflective collar and the at least one LED chip is surface mounted on the mounting substrate.

5. The socket of claim 1 wherein the socket power contacts and the mechanism for maintaining are combined in an integrated contact and bias mechanism.

6. The socket of claim 1 further comprising a releasable locking mechanism.

7. The socket of claim 1 wherein the electrical contacts on the mounting substrate are on a top surface of the mounting substrate and said socket power contacts are arranged to make electrical contact with said top surface electrical contacts.

8. The socket of claim 1 wherein the electrical contacts on the mounting substrate are on a bottom surface of the mounting substrate and said socket power contacts are arranged to make electrical contact with said top surface electrical contacts.

9. The socket of claim 1 wherein the packaged LED lamp includes multiple LED chips and said socket has socket power contacts corresponding to plural sets of electrical contacts on the mounting substrate for said multiple LED chips.

10. The socket of claim 5 further comprising a releasable locking mechanism.

11. The socket of claim 5 wherein the LED lamp includes multiple LED chips and said socket has socket power contacts corresponding to electrical contacts of said multiple LED chips.

12. The LED lighting socket of claim 1 further comprising socket power contacts for multiple packaged LED lamps.

13. An LED lighting module comprising:

a printed circuit board; and a plurality of LED lamp sockets physically mounted and electrically connected on the printed circuit board, wherein the LED lamp sockets provide a releasable mechanism for the ready insertion and removal of packaged LED lamps, each packaged LED lamp comprising a lens and at least one LED chip mounted on a mounting substrate, in the LED lamp sockets without the use of heat, solder, or physical force beyond normal hand pressure.

14. The LED lighting module of claim 13 further comprising an LED lamp inserted in each LED lamp socket.

15. The LED lighting module of claim 13 wherein each LED lamp socket has electrical contacts for making electrical contact with electrical contacts of an LED lamp inserted therein and a spring bias mechanism for biasing LED lamp contacts against the LED lamp socket electrical contacts when the LED lamp is inserted therein.

16. The LED lighting module of 13 wherein each LED lamp socket includes a tray to receive an LED lamp.

17. A portable personal LED light with a replaceable LED lamp comprising:

a power switch for turning power on and off;

a readily releasable LED lamp socket;

an LED lamp comprising an LED chip mounted on a mounting substrate; and a housing wherein the LED lamp may be readily removed and replaced by hand, wherein the readily releasable LED lamp socket comprises:

socket power contacts for contacting lamp power contacts on the LED lamp and supplying power to the LED chip; and a mechanism for maintaining said socket power contacts in electrical contact with said lamp power contacts during operation and for allowing the LED lamp to be readily removed and replaced when it is desired to replace the LED lamp.

18. The battery powered portable light of claim 17 wherein said socket power contacts are point contacts.

19. The battery powered portable light of claim 17 wherein said mechanism for maintaining said socket power contacts in electrical contact with said lamp power contacts comprises a spring biased tray which can be depressed with finger pressure to replace the LED lamp, and which when not depressed provides a spring force to bias said socket power contacts against the lamp power contacts of an LED lamp in said tray.

20. The battery powered portable light of claim 17 wherein the spring biased tray has an inner dimension slightly greater than an outer dimension of a base of the LED lamp.

* * * * *